US009608368B2

(12) United States Patent
Bermel et al.

(10) Patent No.: US 9,608,368 B2
(45) Date of Patent: Mar. 28, 2017

(54) CONTACT DEVICE FOR ESTABLISHING AN ELECTRIC CONTACT BETWEEN A PRINTED CIRCUIT BOARD AND AN ELECTROMOTOR

(71) Applicant: Continental Automotive GmbH, Hannover (DE)

(72) Inventors: Andreas Bermel, Frankfurt am Main (DE); Roland Schneider, Kelkheim/Ts. (DE); Matthias Strack, Kriftel (DE)

(73) Assignee: Continental Automotive GmbH, Hannover (DE)

( * ) Notice: Subject to any disclaimer, the term of this patent is extended or adjusted under 35 U.S.C. 154(b) by 0 days.

(21) Appl. No.: 14/892,688

(22) PCT Filed: May 21, 2014

(86) PCT No.: PCT/EP2014/060418

§ 371 (c)(1),
(2) Date: Nov. 20, 2015

(87) PCT Pub. No.: WO2014/187851

PCT Pub. Date: Nov. 27, 2014

(65) Prior Publication Data

US 2016/0172787 A1 Jun. 16, 2016

(30) Foreign Application Priority Data

May 21, 2013 (DE) ..... 10 2013 209 367

(51) Int. Cl.
*H01R 12/00* (2006.01)
*H01R 13/629* (2006.01)
(Continued)

(52) U.S. Cl.
CPC ..... *H01R 13/629* (2013.01); *H01R 13/631* (2013.01); *H01R 13/74* (2013.01);
(Continued)

(58) Field of Classification Search
CPC . H01R 12/716; H01R 12/724; H01R 13/5213
(Continued)

(56) References Cited

U.S. PATENT DOCUMENTS 4,772,231 A 9/1988 Hayes
4,973,268 A * 11/1990 Smith ..... H01R 13/443 439/589

(Continued)

FOREIGN PATENT DOCUMENTS

DE 69019905 10/1995
DE 69819284 7/2004

(Continued)

OTHER PUBLICATIONS

German Search Report for German Application No. 10 2013 209 367.5 mailed Jan. 22, 2014, including partial translation.

(Continued)

*Primary Examiner* — Phuong Dinh
(74) *Attorney, Agent, or Firm* — RatnerPrestia

(57) ABSTRACT

A device for establishing an electric contact between two electric units, in particular between a printed circuit board and an electromotor, including at least one electric conductor and a plug-in body for receiving the conductor. The plug-in body has a plurality of positioning members for aligning the plug-in body relative to a recess in a receiving body.

14 Claims, 4 Drawing Sheets

(51) Int. Cl.

| | |
|---|---|
| ***H01R 13/631*** | (2006.01) |
| ***H01R 13/74*** | (2006.01) |
| *H01R 12/70* | (2011.01) |
| *H01R 13/52* | (2006.01) |

(52) U.S. Cl.
CPC ..... *H01R 12/7011* (2013.01); *H01R 13/5219* (2013.01); *H01R 2201/26* (2013.01)

(58) Field of Classification Search
USPC ..... 439/76.1, 682, 686, 589
See application file for complete search history.

(56) References Cited

U.S. PATENT DOCUMENTS

| | | | | |
|---|---|---|---|---|
| 5,651,683 | A | 7/1997 | Shimamura | |
| 5,888,101 | A * | 3/1999 | Dent ..... | H01R 13/6453 439/378 |
| 6,152,758 | A | 11/2000 | Matsuoka | |
| 7,311,546 | B2 | 12/2007 | Itou | |
| 7,896,683 | B1 | 3/2011 | Ratzlaff | |
| 2008/0102683 | A1 | 5/2008 | Menez | |
| 2009/0098779 | A1 | 4/2009 | Kawamura | |
| 2010/0099279 | A1 | 4/2010 | Homme | |
| 2010/0254091 | A1 | 10/2010 | Tsuboi | |

FOREIGN PATENT DOCUMENTS

| | | |
|---|---|---|
| EP | 0420010 | 6/1995 |
| EP | 2161790 | 3/2010 |
| EP | 2597730 | 5/2013 |
| JP | 2007080737 | 3/2007 |

OTHER PUBLICATIONS

International Search Report for International Application No. PCT/EP2014/060418 mailed Jul. 30, 2014.

* cited by examiner

CONTACT DEVICE FOR ESTABLISHING AN ELECTRIC CONTACT BETWEEN A PRINTED CIRCUIT BOARD AND AN ELECTROMOTOR

CROSS REFERENCE TO RELATED APPLICATIONS

This application is the U.S. National Phase Application of PCT International Application No. PCT/EP2014/060418, filed May 21, 2014, which claims priority to German Patent Application No. 10 2013 209 367.5, filed May 21, 2013, the contents of such applications being incorporated by reference herein.

FIELD OF THE INVENTION

The invention relates to a device for establishing electrical contact between two electric units, in particular between a printed circuit board and an electric motor and to a control unit for a steering device of a motor vehicle having a printed circuit board and a device according to the invention.

BACKGROUND OF THE INVENTION

In contemporary motor vehicles, a multiplicity of printed circuit boards are installed which have to be protected from external influences by means of a housing. In order to establish the electrical contact between the printed circuit boards and electric machines or the like, there is a need for additional contact devices which, on the one hand, establish the electrical contact between the two units through the housing and, on the other hand, also seal the housing against external influences.

Moreover, in the present case of a printed circuit board for a power steering unit there has been the problem that the printed circuit boards had two differently positioned contacts and the printed circuit boards therefore had to be positioned very precisely during assembly so that both contacts engage correctly in the opposing contact. Furthermore, problems arose during the screwing of the housing of the printed circuit boards to the steering device as a result of imprecisely aligned drilled holes.

SUMMARY OF THE INVENTION

An aspect of the invention is an electrical contact device which permits precise positioning of the printed circuit board.

An aspect of the invention is a device of the type mentioned at the beginning, wherein the plug-in body has a plurality of positioning elements for aligning the plug-in body with a recess in a receiving body, in particular with respect to a rotational angle of the support body with the recess, said angle being located in a plane arranged perpendicularly with respect to the longitudinal axis of the recess.

An aspect of the invention is based on the basic concept of equipping the plug-in body with additional positioning elements, with the result that the plug-in body becomes automatically aligned with the recess in a receiving body, while it is introduced into this recess.

Electric units are understood within the sense of the invention to be self-contained electric structural units. This includes electronic control units, in particular printed circuit boards, electric motors or other electric drive devices which are used in motor vehicles.

The device according to an aspect of the invention is advantageously connected to one of the electric units or the printed circuit board. The printed circuit board can easily be aligned with or positioned correctly with respect to the second unit, for example the electric motor, as soon as the plug-in body is introduced into the recess which is provided for it. The positioning elements permit the plug-in body or the printed circuit board to be aligned at a predefined rotational angle with the receiving body or opposing contact, with the result that the printed circuit board is aligned automatically in the correct rotational angle position, and different electrical contacts on the printed circuit board are positioned precisely with respect to the particular opposing contacts. The same approach can also be applied in the case of a control unit with a printed circuit board and a housing in which the drilled holes for the screw connections on the housing have to be aligned flush with the drilled holes on the opposing body, in order to lead through the screws.

The device according to an aspect of the invention is advantageously developed in that the plug-in body has a first contact face on which the conductor is arranged, wherein the positioning elements are arranged on the first contact face. The contact face represents that face which is introduced first into the recess and on which the electrical conductor for the opposing contact is therefore arranged. The arrangement of the positioning elements on the contact face ensures that the positioning elements come into contact with the recess first and bring about the alignment of the plug-in body.

The device according to an aspect of the invention is advantageously developed in that the positioning elements are arranged in a rotationally symmetrical fashion about the axis which runs perpendicularly through the center point of the contact face.

The device according to an aspect of the invention is advantageously developed in that the positioning elements are each arranged in pairs diametrically opposite one another on the contact face. Correct alignment of the plug-in body with respect to the rotational angle in the plane can be achieved particularly simply and effectively by means of the abovementioned embodiments.

In addition, the device according to an aspect of the invention is developed by means of four positioning elements which are each arranged on one of the center axes of the contact face and at the outer edge of the contact face. With this number of positioning elements it is possible to achieve alignment of the plug-in body particularly effectively.

Furthermore, the device according to an aspect of the invention is developed in that the positioning elements are embodied in the form of fins.

The device according to an aspect of the invention is preferably developed in that the positioning elements have a base shape which tapers toward the edge of the contact face. The positioning elements advantageously have an essentially triangular or semi-circular base shape. In addition it is preferred that the tips of the base shape are embodied in a rounded fashion. In this way, rotation of the plug-in body with respect to the recess about the center point of the contact face is also possible to a small extent, with the result that slight adaptation of the rotational position of the plug-in body or of the printed circuit boards can be brought about during assembly.

The device according to an aspect of the invention is advantageously developed in that the plug-in body is embodied in the form of a cylinder and has an oval, rectangular base shape. By means of this embodiment it is possible to implement a particularly compact design of the plug-in body.

One embodiment of the device according to an aspect of the invention with a sealing lip which is arranged around the lateral face of the plug-in body is particularly preferred. The sealing lip seals the intermediate space between the plug-in body and the recess and prevents the penetration of fluid through the recess.

The device according to an aspect of the invention is advantageously developed in that the positioning elements are arranged essentially flush with the outer face of the sealing lip. The sealing lip is dimensioned in such a way that in the non-installed state it protrudes slightly above the positioning elements. In the installed state, the sealing lip is deformed and bears flush in the range of ±0.1 mm with respect to the positioning elements.

Moreover, one embodiment of the device according to an aspect of the invention is advantageous, in which the plug-in body is formed from a base body and a second body which can be plugged onto the base body, wherein the positioning elements are arranged on the second body. According to this embodiment, the plug-in body is constructed in a modular fashion from two parts or bodies. In this way, particularly easy assembly of the sealing lip on the base body is possible. According to this embodiment, the base body can be configured with a relatively simple geometry, with the result that the injection molding tools which are necessary for this can be manufactured more cost-effectively.

The device according to an aspect of the invention is advantageously developed in that the plug-in body is embodied in one piece with a frame for attaching the plug-in body to a printed circuit board.

Moreover, the device according to an aspect of the invention is developed in that the frame has conductor tracks.

In a particularly advantageous fashion, the device according to an aspect of the invention is developed in that the positioning elements are fabricated with play of 0.01 to 0.13 mm with respect to the recess. By means of these tolerances, it has been possible to implement particularly precise positioning of the plug-in body and of the control device in series assembly.

The invention also comprises a control unit for a steering device of a motor vehicle having a printed circuit board and a device according to one of the preceding embodiments.

BRIEF DESCRIPTION OF THE DRAWINGS

Further preferred embodiments arise from the following description of an exemplary embodiment with reference to figures.

In the drawings.

DETAILED DESCRIPTION OF THE PREFERRED EMBODIMENTS

Figure 1:
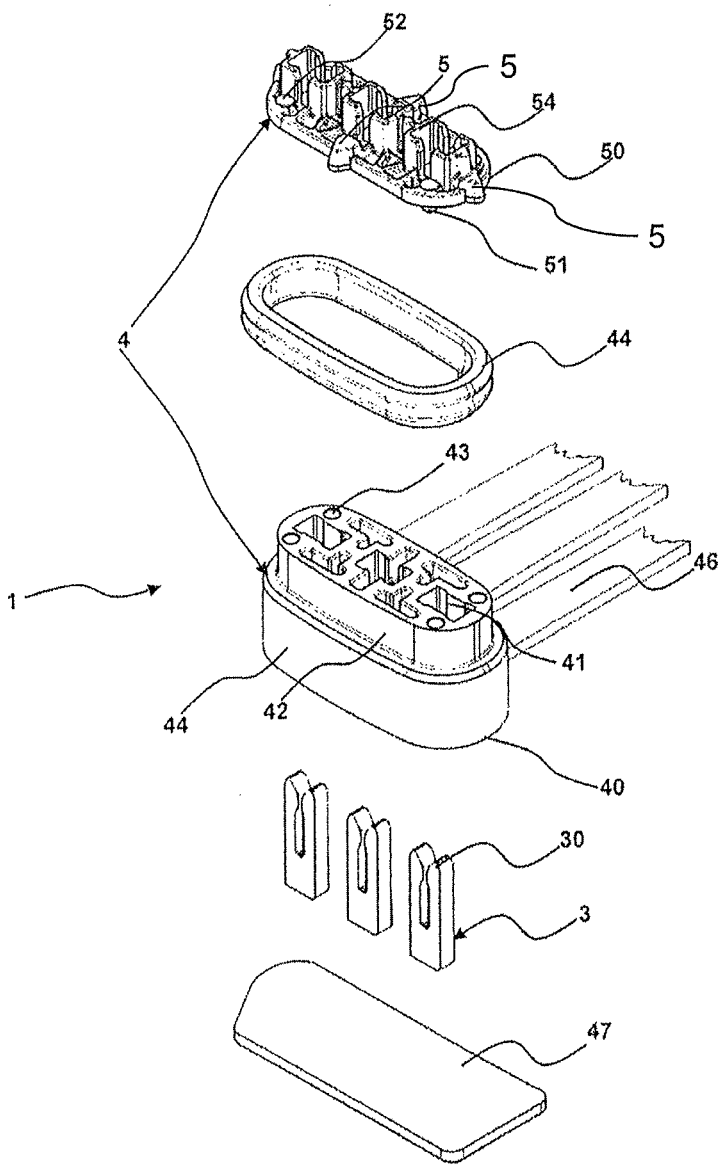
FIG. 1 shows an exploded illustration of a first exemplary embodiment of the device according to the invention.

FIG. 1 shows a device 1 for establishing electrical contact between two electric units, specifically between a printed circuit board 2 and an electric motor (not shown in the figures), having a plurality of electrical conductors 3 and a plug-in body 4 for receiving the conductor 3. The plug-in body 4 has a plurality of positioning elements 5 for aligning the plug-in body 4 with a recess 111 in a receiving body 110, which is part of a steering gear housing to which device 1 is to be assembled.

The plug-in body 4 is embodied in this exemplary embodiment, from a base body 40 and a second body 50 which can be plugged onto the base body 40. However, it is also conceivable to embody the plug-in body 4 in one piece. The base body 40 of the plug-in body 4 is embodied in the form of a cylinder and has an oval base shape. Alternatively, the base shape could be of a rectangular or circular shape. The base body 40 has a plurality of passages 41 which run vertically along the longitudinal axis of the base body 40 and through which the conductors 3 can be plugged. Four circular recesses, which correspond to plug-in pins 51 on the second body 50, are located on an end face 43 of the base body 40. The second body 50 is attached to the base body 40 by means of the plug-in pins 51.

Moreover, one section 42 of the base body 40 is of tapering design and serves to receive a sealing lip 60. The sealing lip 60 is arranged on the lateral face of the tapering section 44 of the base body 40 and serves to seal the recess 111 with respect to the receiving body 110 and with respect to the lateral face of the tapering section 44. The sealing lip 60 can be integrally injection molded directly onto the base body 40 or be mounted as an individual component on the base body 40. The sealing lip 60 is an optional element and can also be omitted. In one embodiment of the device according to the invention without a sealing lip, the tapering section 42 would be omitted.

Figure 4:
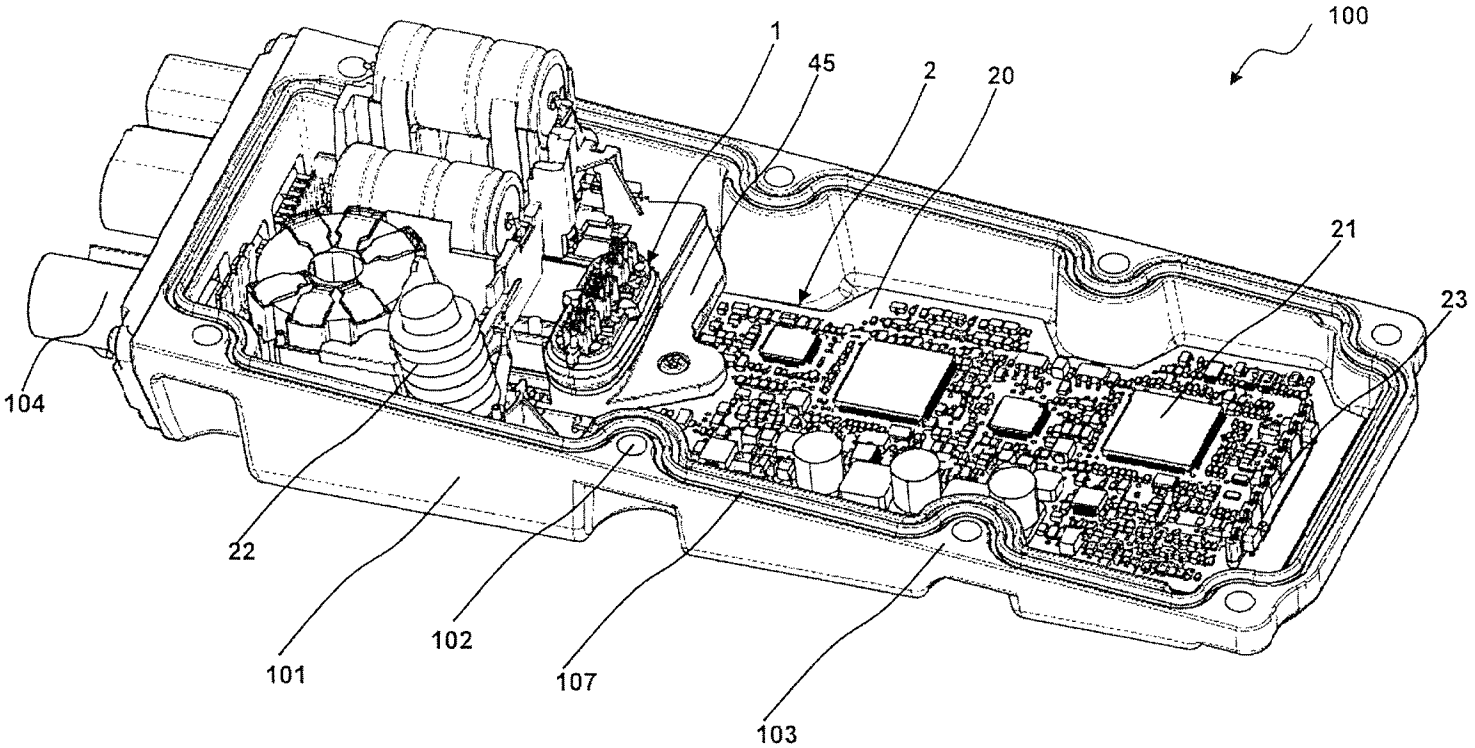
FIG. 4 shows a perspective view of a control unit for a power steering device with the first exemplary embodiment of the device according to the invention.

On the non-tapering section 44 of the base body 40 there are parts of a frame 45 for attaching the plug-in body 4 to a printed circuit board 2, see FIG. 4. The base body 40 is embodied in one piece with the frame 45. The frame 45 is equipped with conductor tracks 46, wherein the conductor tracks 46 are electrically connected to the conductors 3. For this purpose, the base body 40 has horizontally running recesses (not shown in the figures) through which the conductor tracks 46 can be lead, and through which they project in certain sections into the passages 41, in order to make electrical contact with the conductors 3.

In addition, the plug-in body 4 has a cover 47, with which the lower end of the base body 40 can be covered and which supports the electrical conductors 3. The cover 47 can be configured in such a way that it can be plugged onto the base body 40.

Figure 3:
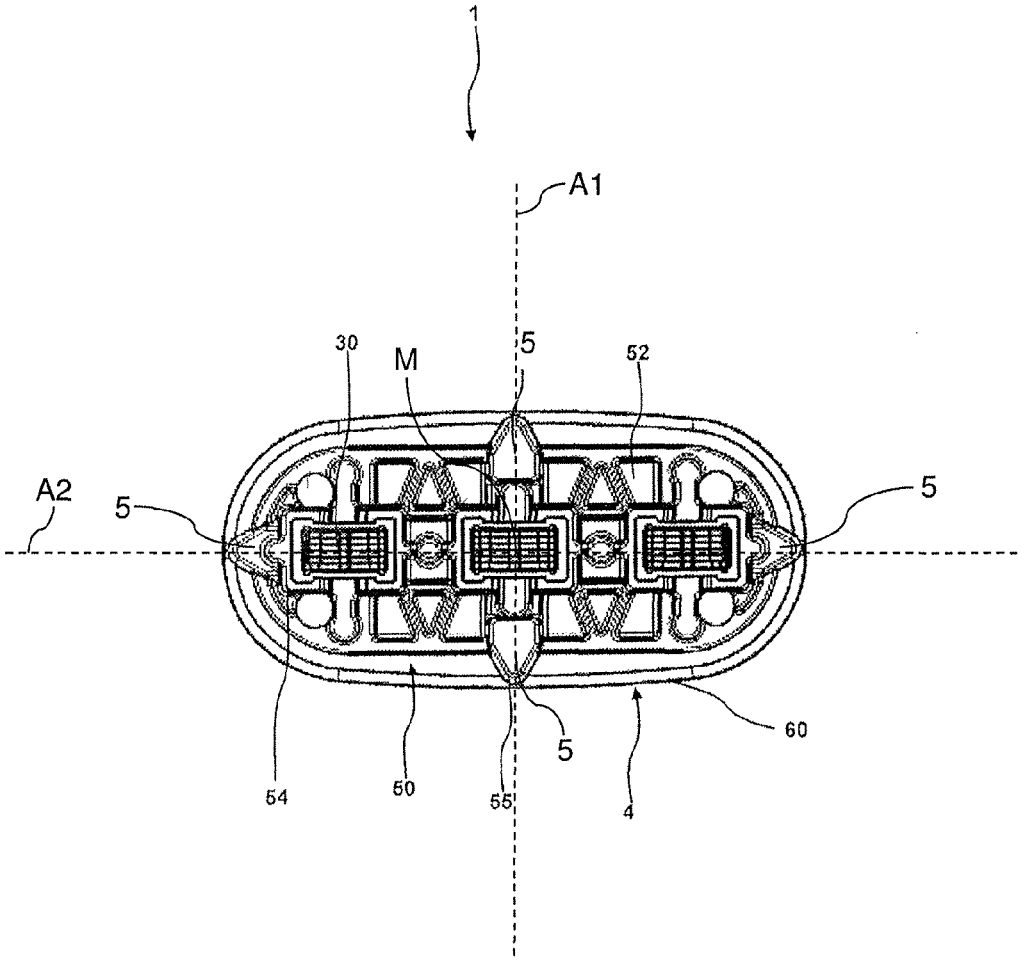
FIG. 3 shows a plan view of the first exemplary embodiment of the device according to the invention.

The second body 50 is embodied in the form of a plate and has, at the edge regions, a plurality of positioning elements 5 for orienting the plug-in body 4 with the recess 111. The second body 50 has a contact face 52 on which the contact sections of the conductors 3 are arranged, wherein the positioning elements 5 are arranged on the first contact face 52. The positioning elements 5 are arranged in a rotationally symmetrical fashion about the axis which runs perpendicularly through the center point (M) of the contact face (52). In this exemplary embodiment, the center point M corresponds to the point of intersection of the center axes A1, A2 of the contact face 52, cf. FIG. 3. The four positioning elements 5 are each arranged on one of the center axes A1, A2 at the outer edge of the contact face 52, so as to lie diametrically opposite one another in pairs. In addition, the positioning elements 5 are arranged in such a way that in the installed state they terminate essentially flush with the outer face of the sealing lip 60, as illustrated in FIG. 3.

Figure 2:
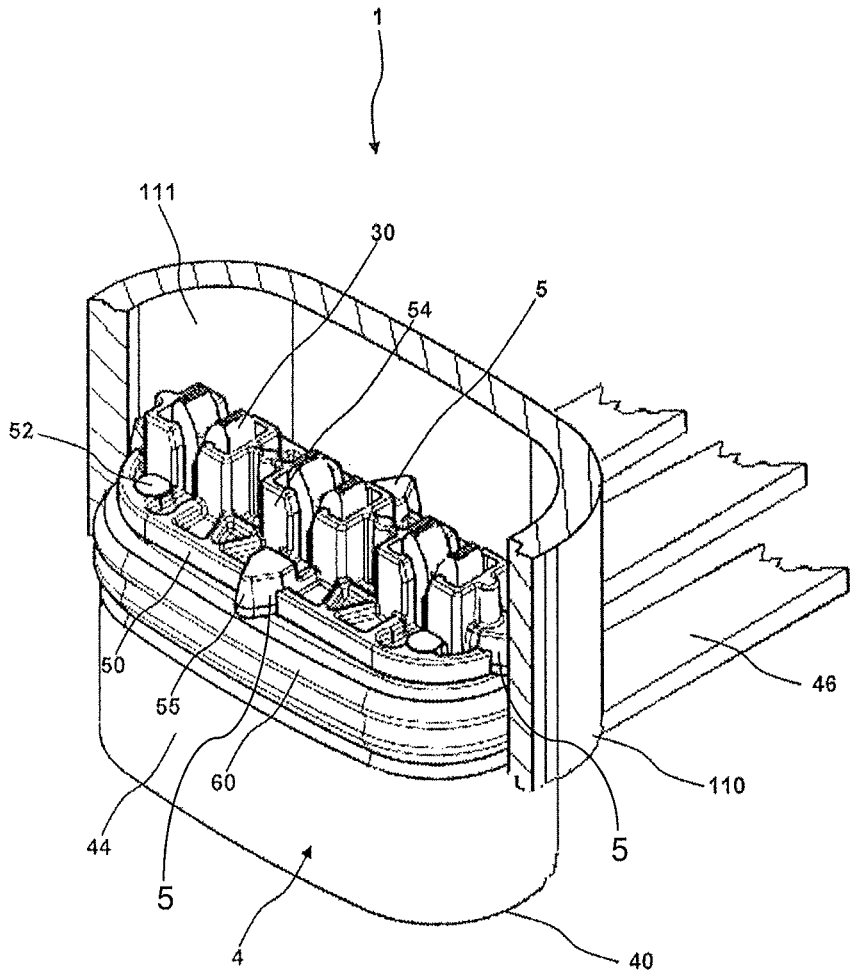
FIG. 2 shows a perspective view of the first exemplary embodiment of the device according to the invention.

The positioning elements 5 are embodied in the form of fins and have a base face which tapers toward the edge of the contact face 52 and is essentially triangular. In this way, a rounded contact region 55 is produced between the positioning elements 5 and the inner wall of the recess 111, in order to permit slight rotation of the plug-in body 4 within the recess 111. In addition, the contact region 55 is, as can be seen in FIG. 2, embodied so that it tapers slightly with respect to the free end face of the positioning elements 5, in order to facilitate the introduction of the plug-in body 4 into the recess 111. For this purpose it is also provided that the positioning elements 5 are fabricated with play of 0.01 to 0.13 mm with respect to the recess 111. The height of the positioning elements 5 corresponds approximately to twice the thickness of the second body 50.

On the contact face 52 of the second body 50 there are also supporting walls 54 for supporting the pins 30 of the conductor 3 when the opposing contact is introduced between the pins 30, and the pins 30 are therefore spread apart from one another. The positioning elements 5 which are arranged on the shorter sides are continuous here in a flush fashion with the respectively adjacent supporting walls 54.

The plug-in body 4 or the base body 40 and the second body 50 are fabricated from a thermoplastic material. Polybutylene terephthalate is particularly preferred.

FIG. 4 shows a control unit 100 for a power steering device of a steering device of a motor vehicle having a printed circuit board 2 and the device 1 for establishing electrical contact between the printed circuit board 2 and the electric motor.

The printed circuit board 2 has a carrier board 20 on which a multiplicity of electronic components 21 and electrical components 22 are mounted. These comprise, inter alia, chip modules, capacitors, coils etc. The device 1 is arranged on one half of the carrier board 20.

The device 1 is connected to the carrier board 102 via the frame 45. Spaced apart from this, at the other end of the carrier board 20, are further electrical contacts 23 via which, inter alia, the rotational angle signals of the electric motor are transmitted to the printed circuit boards 2.

The printed circuit board 2 is arranged within a metal housing 101. The housing has a plurality of drilled holes 102 in order to screw the housing 101 onto a steering gear housing (not shown here). The contact face 103 of the housing 101 which makes contact with this steering gear housing is provided with a sealing lip 107 in order to seal the housing 101 in a water-tight fashion. Furthermore, the housing 101 has a plurality of connections 104 on its end face, by means of which connections 104 the printed circuit board 2 can be connected, for example, to a battery.

When the steering device is assembled, the control unit 100 is moved down to the steering gear housing and subsequently fitted onto the steering gear housing, with the result that the device 1 is introduced into the recess 111 (see FIG. 2) of the steering gear housing and moves the printed circuit board into the position provided, in particular the rotational angle position, with respect to the steering gear housing. This involves rotating in the plane which is perpendicular to the longitudinal axis of the extent 111, about the center point M. The device 1 according to the invention permits correct positioning of the control unit 100 with respect to the steering gear housing, even if the control unit 100 is moved with a rotational angle offset of several degrees with respect to the rotational angle position which is provided. For this purpose, the device 1 has a plurality of positioning elements 5 which interact with the recess 111 in such a way that the control unit 100 is aligned in the correct position. As a result, no problems occur either during the establishment of the electrical contact between the electrical contacts 23 and the opposing contacts which correspond thereto.

The invention claimed is:

1. A device for establishing electrical contact between two electric units having at least one electrical conductor and a plug in body for receiving the conductor, wherein the plug in body has a plurality of positioning elements for aligning the plug in body with a recess in a receiving body, wherein the positioning elements have a base shape which tapers toward an edge of a contact face of the plug in body.

2. A device for establishing electrical contact between two electric units having at least one electrical conductor and a plug in body for receiving the conductor, wherein the plug in body has a plurality of positioning elements for aligning the plug in body with a recess in a receiving body, wherein the plug in body has a first contact face on which the conductor is arranged, and wherein the positioning elements are arranged on the first contact face.

3. The device as claimed in claim 1, wherein the positioning elements are arranged in a rotationally symmetrical fashion about the axis which runs perpendicularly through a center point of the contact face.

4. The device as claimed in claim 1, wherein the positioning elements are each arranged in pairs diametrically opposite one another on the contact face.

5. A device for establishing electrical contact between two electric units having at least one electrical conductor and a plug in body for receiving the conductor, wherein the plug in body has four positioning elements for aligning the plug in body with a recess in a receiving body, the four positioning elements each arranged on one of the center axes of a contact face of the plug in body and at the outer edge of the contact face.

6. The device as claimed in claim 1, wherein the positioning elements are embodied in the form of fins.

7. The device as claimed in claim 1, wherein the plug in body is embodied in the form of a cylinder and has an oval or rectangular base shape.

8. The device as claimed in claim 1, comprising a sealing lip which is arranged around a lateral face of the plug in body.

9. The device as claimed in claim 8, wherein the positioning elements are arranged essentially flush with an outer face of the sealing lip.

10. The device as claimed in claim 1, wherein the plug in body is formed from a base body and a second body which can be plugged onto the base body, wherein the positioning elements are arranged on the second body.

11. The device as claimed in claim 1, wherein the plug in body is embodied in one piece with a frame for attaching the plug in body to a printed circuit board.

12. The device as claimed in claim 1, wherein the positioning elements are fabricated with play of 0.01 to 0.03 mm with respect to the recess.

13. A device for establishing electrical contact between two electric units having at least one electrical conductor and a plug in body for receiving the conductor, wherein the plug in body has a plurality of positioning elements for aligning the plug in body with a recess in a receiving body, wherein the plug in body is embodied in one piece with a frame for attaching the plug in body to a printed circuit board, and wherein the frame has conductor tracks.

14. A control unit for a steering device of a motor vehicle having a printed circuit board and a device for establishing electrical contact between the printed circuit board and an electric unit, the device having at least one electrical conductor and a plug in body for receiving the conductor, wherein the plug in body has a plurality of positioning elements for aligning the plug in body with a recess in a receiving body.

* * * * *